US006325119B1

(12) United States Patent
Wolf et al.

(10) Patent No.: US 6,325,119 B1
(45) Date of Patent: Dec. 4, 2001

(54) DEVICE FOR PRODUCING SQUARE BEAMS FROM TREE TRUNKS

(76) Inventors: Johann Wolf, Schonenbuhl 6, CH-9050 Appenzell (CH); Dale Sanborn, P.O. Box 245, Rte. 37, South Waterford, ME (US) 04088

( * ) Notice: Subject to any disclaimer, the term of this patent is extended or adjusted under 35 U.S.C. 154(b) by 0 days.

(21) Appl. No.: 09/544,607

(22) Filed: Apr. 6, 2000

(30) Foreign Application Priority Data

Apr. 7, 1999 (AT) ..... 612/99

(51) Int. Cl.[7] ..... B27B 1/00; B27B 29/00; B27B 31/04

(52) U.S. Cl. ..... 144/378; 83/365; 83/367; 83/439.11; 83/412; 83/708; 83/801; 144/357; 144/242.1

(58) Field of Search ..... 144/3.1, 39, 41, 144/356, 357, 377, 378, 382; 83/365, 367, 435.11, 435.12, 412, 524, 708, 801, 813

(56) References Cited

U.S. PATENT DOCUMENTS

| | | | | |
|---|---|---|---|---|
| 4,294,149 | * | 10/1981 | Olsson | 144/378 |
| 4,697,487 | | 10/1987 | Cameron | 83/708 |
| 4,846,237 | * | 7/1989 | Wolf | 144/377 |
| 5,035,166 | * | 7/1991 | Carlson et al. | 144/378 |
| 5,109,899 | | 5/1992 | Hendrickson | 144/378 |
| 5,135,037 | | 8/1992 | Wijesinghe | 144/357 |
| 5,228,490 | | 7/1993 | Wolf | 144/357 |
| 5,253,685 | | 10/1993 | Wolf | 144/378 |

FOREIGN PATENT DOCUMENTS

| | | |
|---|---|---|
| 346 570 | 10/1978 | (AT) . |
| 382 549 | 3/1987 | (AT) . |
| 390 025 | 3/1990 | (AT) . |
| 397 058 | 1/1994 | (AT) . |
| 397 224 | 2/1994 | (AT) . |
| 398 723 | 1/1995 | (AT) . |
| 24 58 461 | 6/1976 | (DE) . |
| 26 14 349 | 10/1976 | (DE) . |
| 27 40 985 | 3/1978 | (DE) . |
| 29 47 993 | 7/1981 | (DE) . |
| 33 17 303 | 11/1984 | (DE) . |
| 37 44 322 | 3/1989 | (DE) . |
| 42 01 202 | 7/1993 | (DE) . |
| 0 217 784 | 4/1987 | (EP) . |
| 0 222 728 | 5/1987 | (EP) . |
| 0 770 461 | 5/1997 | (EP) . |
| 0 891 846 | 1/1999 | (EP) . |
| 9-85703 | 3/1997 | (JP) . |

* cited by examiner

*Primary Examiner*—W. Donald Bray
(74) *Attorney, Agent, or Firm*—Young & Thompson

(57) ABSTRACT

To produce square beams from tree trunks (13), a device is proposed in which a tree trunk (13) is first positioned by a centering device (4) such that the lengthwise axis (14) of the tree trunk (13) assumes essentially always the same stipulated position. The tree trunk (13) is then grasped by holders (11, 12) of a carriage (8) concentrically to the lengthwise axis (14), whereupon the centering device (4) is opened. Then the tree trunk (13) is guided through a band saw (5) and trimmed on the opposite sides, whereupon it is turned by 90° and the two other sides of the tree trunk (13) are trimmed.

12 Claims, 2 Drawing Sheets

DEVICE FOR PRODUCING SQUARE BEAMS FROM TREE TRUNKS

FIELD OF THE INVENTION

The invention relates to a device for producing square beams from tree trunks with two tools which trim the trunks on two opposite sides, with a holding device in which a tree trunk is grasped on the end face while it is being worked, and the holding device and the tools can be moved relative to one another during working, and with a means for positioning the tree trunk which is opened during working before the trunk is grasped by the holding device.

BACKGROUND OF THE INVENTION

When producing square beams with or without rough edges, it is important for the side surfaces of the square beam to be produced parallel to the lengthwise or middle axis of the tree trunk, since this is important both for the structure and strength of the square beam and also with respect to the cut rough edges when they are processed further for example into small parts (laths). It is therefore important for the tree trunks to be positioned in the same location of the lengthwise axis as much as possible parallel to the direction of motion in which a holding device for the tree trunk and the tools are moved relative to one another in order to minimize the adjustment effort for the holding device and the tools. This however results in the holding device grasping the tree trunks with always the same location of the lengthwise axis.

AT 397 058 B discloses a device of the initially mentioned type which has a means for positioning the tree trunk which is opened during working and the tree trunk is held on the end face during working. If with the known device square beams are to be produced, the tree trunk must be turned 90° after working the two first sides which are opposite one another. Here it is disadvantageous that the tree trunk was originally not grasped in the middle, since based on its conical shape it was positioned with a lengthwise axis which is oblique in the vertical direction. The tree trunk must therefore be positioned again after turning and must be grasped by the holding device so that the other two sides of the tree trunk can also be worked parallel to the lengthwise axis.

EP 222 728 A and EP 217 784 A disclose devices for producing square beams which grasp the tree trunk such that the location of its lengthwise axis viewed in the horizonal direction is always aligned the same. The height of the lengthwise axis of the individual tree trunks or their alignment in the vertical plane however, depending on the diameter of the tree trunk, is not always fixed exactly the same. Furthermore the holding devices described there on the same page are the means for positioning the tree trunks, i.e. there are no additional system parts which position the tree trunk before grasping by the holding device in which it is held during working.

SUMMARY OF THE INVENTION

The object of the invention is to devise a device of the initially mentioned type in which the lengthwise axis of the tree trunks always assumes the same position parallel to the direction of movement in the holding device.

This object is achieved with a device with the features of claim 1.

With the invention a centering device is proposed which automatically positions the lengthwise axis of the tree trunks in always the same position, i.e. without intervention from the outside via a control means. In this position the tree trunks are grasped by the holding device and the square beam can be easily produced symmetrically to the lengthwise axis of the tree trunk.

Since due to the always same position of the lengthwise axis of the tree trunks they can be grasped exactly centrally by the holders, the tree trunks can be worked without major technical effort first on two opposite sides and then turned by 90°, whereupon they can be worked on the two remaining sides.

In AT 397 224 B a holding device is described which is able to position a tree trunk with a lengthwise axis which is flush to the direction of working, but there it is neither a holding device in which a tree trunk can be swivelled 90°, nor is functional separation of the holding device and centering device shown.

In one preferred embodiment of the device it is characterized in that the centering device has two pairs of legs which have V-shaped recesses which face one another. Here it can either be provided that the legs can be moved translationally towards one another or that the legs can be moved rotationally towards one another.

Here one pair of legs at a time is assigned to one end of the tree trunk, and the tree trunk with its ends which are held in the V-shaped depressions, when the centering device is closed., i.e. when the legs are moved towards one another, is fixed automatically in always the same location of its lengthwise axis.

It goes without saying that by virtue of the circumstance that tree trunks of course are never perfectly round, the location of the lengthwise axis within the framework of these natural fluctuations can deviate from the ideal position which is stipulated purely geometrically by the V-shaped recesses. Other advantageous embodiments of the invention are the subject matter of the other dependent claims.

BRIEF DESCRIPTION OF THE DRAWINGS

In the following, embodiments of the invention are described with reference to the drawings.

DESCIPTION OF THE PREFERRED EMBODIMENTS

Figure 1:
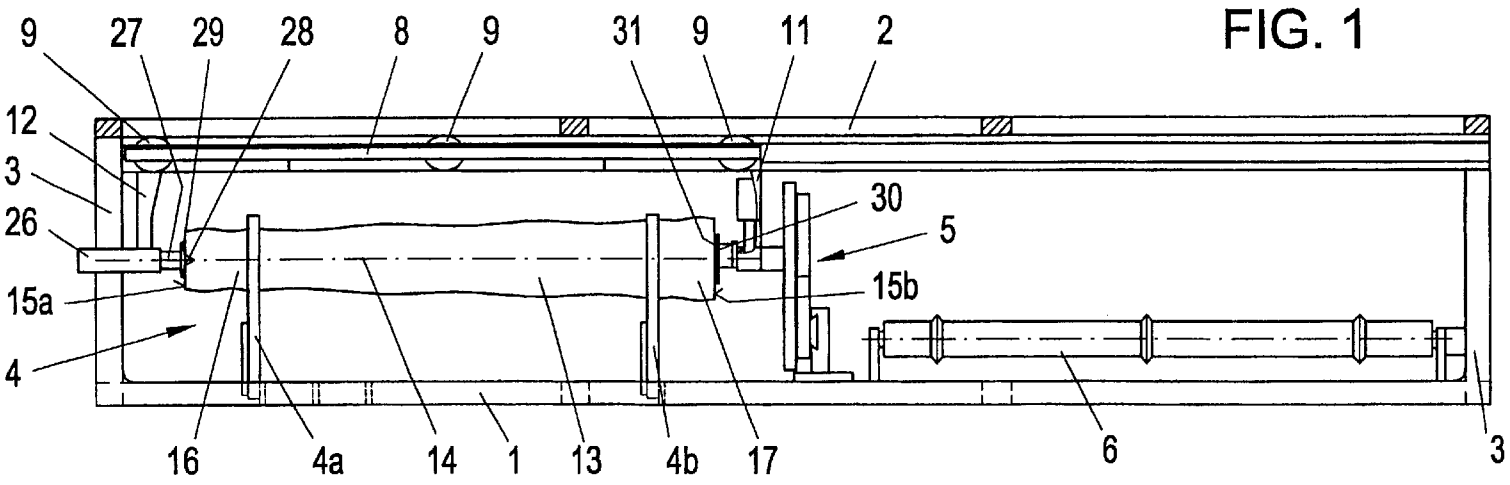
FIG. 1 shows a first embodiment of the invention in a side view.
Figure 4:
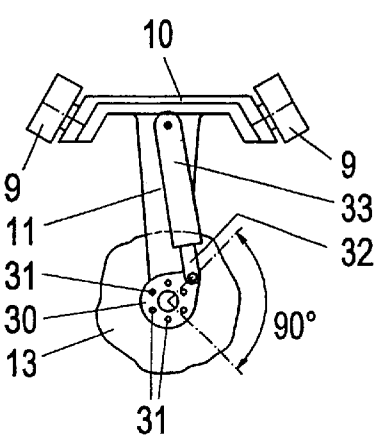
FIG. 4 shows a detail of a holding device for the tree trunk.
Figure 3:
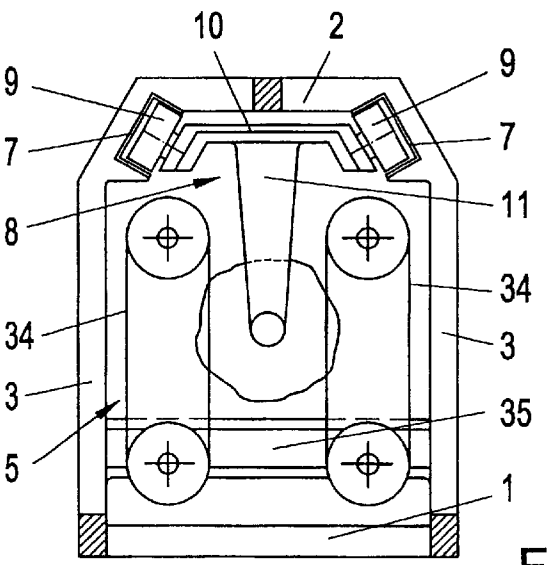
FIG. 3 shows a section through the device from FIG. 1 in the area of the tools.

FIGS. 1 and 3 show a first embodiment of the device as claimed in the invention which has a base frame 1 and a guide frame 2, the guide frame 2 being joined to the base frame 1 via supports 3. On the base frame 1 the centering device 4, a saw 5 and a chain conveyor 6 are supported.

The guide frame 2 has two guide rails 7 with a U-shaped cross sectional in which a holding device 8 can be adjusted via three pairs of rollers 9 by a drive (not shown), for example a tackle line. The holding device 8 which is made as a carriage in this embodiment has a frame 10 on which the rollers 9 are supported. From this frame 10 holders 11 and 12 extend downward and grasp a tree trunk 13 on its end faces 15*a*, 15*b* after it has been positioned by the centering device 4 such that its lengthwise axis 14 has essentially assumed a stipulated position.

Figure 2:
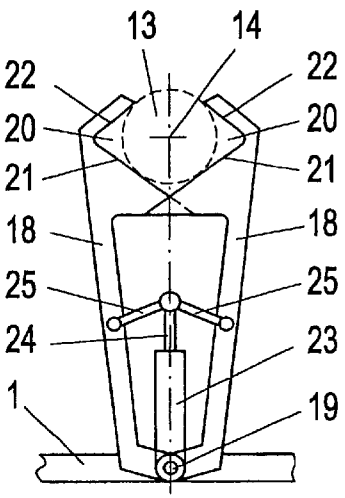
FIG. 2 shows a part of the centering device.

The centering device 4 consists of two parts 4*a*, 4*b* which are made identical and which grasp the tree trunk 13 in the area of its ends 16 and 17. The parts 4*a* and 4*b* of the centering device 4 are made as shown in FIG. 2 and have two legs 18 which are arranged in a mirror image and are supported to be able to swivel on the base frame 1 around an axle 19. The legs 18 on their ends opposite the axle 19 have a fork shape which widens in the manner of a V, the V-shaped recesses 20 facing one another or widening in the direction to one another. The V-shaped recesses 20 are bounded by bottom support surfaces 21 and top support surfaces 22, the bottom support surfaces 21 being longer than the top support surfaces 22.

The legs 18 are activated by means of a hydraulic cylinder 23 which on the cylinder side is supported coaxially to the swivel axis 19 of the legs 18. The piston rod 24 is hinged to the legs 18 via two levers 25. By extending the piston rod 24 the legs 18 are moved towards one another, and away from one another by retracting the piston rod 24.

If a tree trunk 13 is supplied using a transverse conveyor means which is not shown, for example a chain conveyor, the legs 18 of the centering device are moved away from one another by retracting the piston rod 24 to such an extent that the tree trunk 13 can drop into the V-shaped recesses 20 in the centering device 4. This is possible because the top support surfaces 22 are shorter than the bottom support surfaces 21 onto which the tree trunk 13 drops. Then the piston rod 24 on the cylinder 23 is extended, by which the legs 18 are moved towards one another and the tree trunk 13 is fixed in the V-shaped recesses in the manner of tongs. Regardless of the diameter of the tree trunk 13 in the area of the pair of legs 4*a* and 4*b* of the centering device 4, the lengthwise axis 14 of the tree trunk is essentially always fixed in exactly the same location both in the horizonal and vertical direction. Small deviations from the stipulated position can occur in any case by the deviations of the cross section of the trunk from the ideal round cross section.

So that the location of the lengthwise axis 14 of the tree trunk 13 is also fixed in the horizontal direction, the centering device 4 has means which are not shown in the drawings for holding the device exactly over the swivel axis 19.

Since the tree trunk 13 has been fixed as centered by the centering device 4, it is grasped on its end faces 15*a* and 15*b* by the holding devices 11 and 12. The holding device 12 has a hydraulic cylinder 26 with a piston rod 27 which has centrally on its free end a mandrel 28 and a plate 29 which limits the depth of penetration of the mandrel 28. The horizontal and vertical location of the mandrel 28 relative to the centering device 4 is aligned such that it penetrates exactly into the end face 15*a* of the tree trunk 13 in the area of the lengthwise axis 14.

To be able to match the device as claimed in the invention to different tree trunk lengths (generally 4, 5, or 6 m), both the holder 12 and also the part 4*a* of the centering device 4 can be adjusted incrementally or continuously in the lengthwise direction. For this reason the stroke of the hydraulic cylinder 26 need also be only relatively small, for example 15 cm, in order to press the tree trunk 13 securely against the other holding device 11.

The second holding device 11 has a pivotally mounted disk 30 which has several mandrels 31 distributed over the periphery and which are pressed into the end face 15*b* of the tree trunk 13. The piston rod 32 of a hydraulic cylinder 33 engages the disk 30 eccentrically and is supported on the cylinder side on the holding device 11. The axis of rotation of the disk 30 is flush with the lengthwise axis 14 of the tree trunk 13. By actuating the hydraulic cylinder 33 the disk 30 can be turned with the tree trunk 13 by 90°.

After the tree trunk 13 has been inserted into the centering device 4, the latter is preferably closed automatically by a sensor being activated which activates the hydraulic circuit of the closing cylinder 23. The sensor can be a mechanical lever which is moved by the tree trunk 13 and thus opens a valve in the hydraulic circuit or, for example a photoelectric barrier which actuates a solenoid valve in the hydraulic circuit.

By clamping the tree trunk 13 the pressure in the hydraulic circuit of the centering device 4 rises and this pressure rise can be used to activate the hydraulic circuit of the hydraulic cylinder 26 of the holder 12 by means of a pressure-dependent valve in order to clamp the tree trunk 13 between the mandrel 28 and the disk 30 in the axial direction. The associated pressure rise in the hydraulic circuit of the hydraulic cylinder 26 can in turn be used to open the hydraulic circuit of the hydraulic cylinder 23 of the centering device 4. For example, a three-way valve is activated which bypasses the reversal in the supply of the hydraulic cylinder 23 with a feed line to the hydraulic circuit of the cylinder 26. Movement of the carriage 8 with the holders 11, 12 is not hindered by the opened pair of legs 4*a* and 4*b*. With the same means and at the same time the advance of the carriage 8 is turned on and the carriage is driven for example by a tackle line or a rack gear drive. The tree trunk 13 then passes through two band saws 34 of the saw 5, which are shown schematically in FIG. 3. The band saws 34 can be moved synchronously towards or away from one another on a guide 35, among others to be able to match the cut width to the diameter of the tree trunk 13.

During passage of the tree trunk 13 through the band saws 34 the tree trunk 13 is trimmed on two opposite sides. On the end of the conveyor path of the tree trunk 13, i.e. in FIG. 1 fully to the right, there is a starting switch which is not shown and which causes return of the carriage 8. During return, the band saws 34 are moved apart in order to prevent damage to them. Then the tree trunk 13 is turned by 90° by activating the hydraulic cylinder 33 and the tree trunk 13 is trimmed in the second passage through the hand saws 34 on the third and fourth side.

After the second passage, when therefore all fours sides are worked, this is recognized by a photoelectric barrier and it switches the hydraulic circuit of the cylinder 26 via a relay and a solenoid valve to "open", by which the piston rod 27 of the holder 12 is retracted and the beam falls onto the underlying chain block 6 and is discharged laterally.

Alternatively, when the band saws 34 are provided with two-sided teeth, the tree trunk 13 can be turned directly after the first pass through the band saws 34 by 90° and upon return are worked by the band saws 34 on the third and fourth side. It goes without saying that the chain block 6 is eliminated in this case and instead a removal device must be provided for the square beam in the area of the centering device 4.

The band saws 34 are adjusted as already mentioned by means of motor actuators which are not shown and which are controlled by a computer. For example, on the pair of legs 4*b* of the centering device 4, i.e. the pair which is adjacent to the saw 5, there is a rotary pulse generator which acquires the swivel angle of a leg 18 which corresponds to the diameter of the clamped tree trunk 13 and routes the adjustment values for the saws to a computer which is provided with an optimization program with consideration of the choice between a pure square beam or square beams with rough edges. The individual sequences in the course of centering and working a tree trunk 13 can also be controlled in any other way, for example with photoelectric barriers, feelers, or the like.

Figure 5:
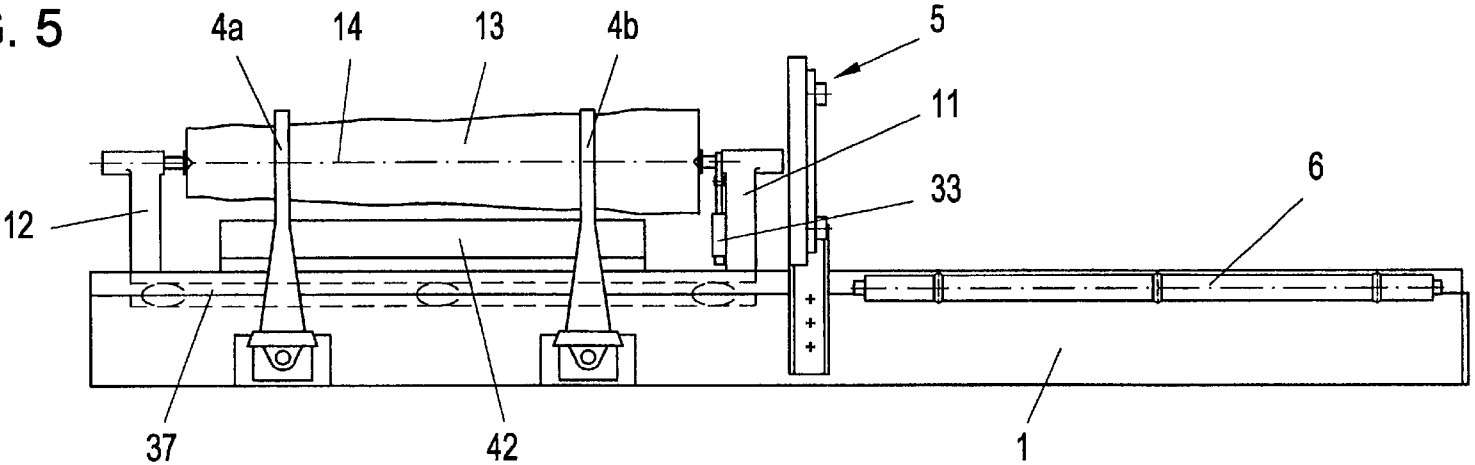
FIG. 5 shows a second embodiment of the device as claimed in the invention in a side view.
Figure 6:
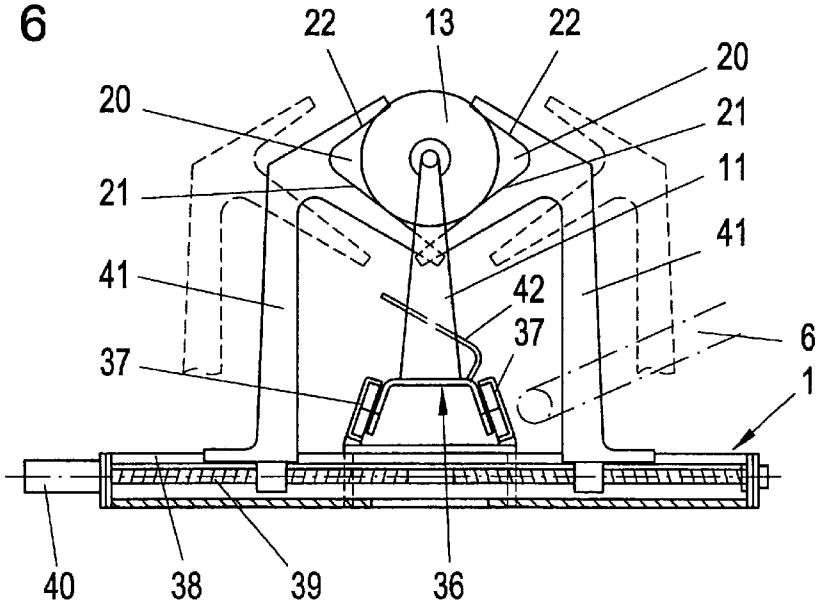

FIGS. 5 and 6 show a second embodiment of the invention in which a holding device or a carriage 36 is guided for the tree trunk 13 underneath the latter in the guide rails 37 which are permanently connected to the base frame 1. Aside from this, the embodiment of the holders 11, 12 corresponds to that of the holders 11, 12 as were described in conjunction with the embodiment of FIGS. 1 to 4.

Figure 7:
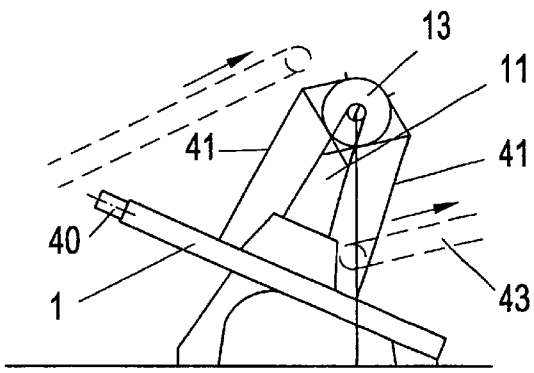
FIG. 6 shows a detail of the device from FIG. 5 in the area of the centering device and FIG. 7 shows schematically another embodiment of the invention with slanted frame of the device for the holding device and the centering device.

Furthermore, the embodiment of FIGS. 5 to 7 differs from the embodiment of FIGS. 1 to 4 by the legs 41 of the centering device 4 being opened and closed not by swivelling, therefore rotationally, but by linear movements, therefore translationally.

To do this the legs 41 are supported to be able to move on the guide rails 38 and are driven in opposite directions by the threaded spindles 39 by means of motor actuators 40. Aside from this, the legs 41 however correspond to the legs 18 from FIG. 2, i.e. that they have V-shaped recesses 20 with bottom support surfaces 21 which are longer than the top support surfaces 22.

Also in the embodiment which is shown in FIGS. 5 and 6 the tree trunk 13 can be worked by passing twice through the saw 5 in the same direction or by the fact that two sides of the tree trunk 13 are worked upon passage in one direction and the two other sides are worked when conveyed back.

As can be seen in FIGS. 5 and 6, on the carriage 36 between the holders 11 and 12 there is a slide sheet 42 via which the separated sections and the finished square beam slide onto an outgoing chain conveyor.

In order to facilitate the removal of the cut parts and the square beam, the base frame 1 as is shown in FIG. 7 can be tilted at an angle between 30 and 45° to the horizontal, so that a removal means 43 can be guided more easily to under the tree trunk 13.

In summary, one preferred embodiment of the device as claimed in the invention can be described as follows.

To produce square beams from tree trunks 13, a device is proposed in which a tree trunk 13 is first positioned by means of a centering device 4 such that the length-wise axis 14 of the tree trunk 13 assumes essentially always the same stipulated position. The tree trunk 13 is then grasped by holders 11, 12 of a carriage 8 concentrically to the length-wise axis 14, whereupon the centering device 4 is opened. Then the tree trunk 13 is guided through a band saw 5 and trimmed on the opposite sides, whereupon it is turned by 90° and the two other sides of the tree trunk 13 are trimmed.

What is claimed is:

1. Device for producing square beams from tree trunks, which comprises:

two tools which trim the trunks on two opposite sides;

a holding device structured and arranged to grasp a tree trunk having a lengthwise axis on an end face while said trunk is being worked;

said holding device and said tools being movable relative to one another during working;

means for positioning the tree trunk; said means being opened during working before the trunk is grasped by the holding device; and said means for positioning comprising a centering device which positions the tree trunk automatically in essentially always the same stipulated position of the lengthwise axis of the tree trunk parallel to the direction of movement.

2. The device according to claim 1, wherein the centering device has two pairs of legs which have V-shaped recesses which face one another.

3. The device according to claim 2, wherein the legs have a fork shape which widens in a V-shape.

4. The device according to claim 2, wherein the legs laterally engage the tree trunk, and wherein bottom support surfaces of the V-shaped recesses are longer than top support surfaces.

5. The device according to claim 2, wherein the legs are adapted to move translationally towards one another.

6. The device according to claim 5, wherein the legs are supported for movement on guide rails and are driven in opposite directions by a threaded spindle by motor actuators.

7. The device according to claim 1, wherein the legs are adapted to move rotationally towards on another.

8. The device according to claim 7, wherein the legs are adapted to swivel around a same axle.

9. The device according to claim 7, further comprising a hydraulic cylinder assigned to each pair of legs for driving the legs, said hydraulic cylinder being hinged to a leg via one lever at a time.

10. The device according to claim 1, wherein the holding device runs on guide rails located under the tree trunk and provided on a frame, and said centering device being tilted at an angle relative to the horizontal.

11. The device according to claim 10, wherein the angle is between 30 and 45°.

12. The device according to claim 3, wherein the legs laterally engage the tree trunk, and wherein bottom support surfaces of the V-shaped recesses are longer than top support surfaces.

* * * * *